US011982485B1

(12) United States Patent
Xu et al.

(10) Patent No.: US 11,982,485 B1
(45) Date of Patent: May 14, 2024

(54) AUTOMATED THREE-DIMENSIONAL REFRIGERATED WAREHOUSE FOR MEAT INDUSTRY AND USING METHOD

(71) Applicant: Hefei Polytechnic University, Hefei (CN)

(72) Inventors: Baocai Xu, Hefei (CN); Zhaoming Wang, Hefei (CN); Yong Xie, Hefei (CN); Hui Zhou, Hefei (CN); Yuanbo Hu, Hefei (CN)

(73) Assignee: HEFEI POLYTECHNIC UNIVERSITY, Hefei (CN)

( * ) Notice: Subject to any disclaimer, the term of this patent is extended or adjusted under 35 U.S.C. 154(b) by 0 days.

(21) Appl. No.: 18/385,397

(22) Filed: Oct. 31, 2023

(30) Foreign Application Priority Data

Nov. 9, 2022 (CN) ..... 202211400494.3

(51) Int. Cl.
*F25D 13/06* (2006.01)
*F25B 7/00* (2006.01)
*F25D 25/04* (2006.01)

(52) U.S. Cl.
CPC ..... *F25D 13/06* (2013.01); *F25B 7/00* (2013.01); *F25D 25/04* (2013.01)

(58) Field of Classification Search
CPC ..... F25D 13/06; F25D 13/00; F25D 25/04; F25D 25/027
See application file for complete search history.

(56) References Cited

U.S. PATENT DOCUMENTS 4,202,436 A * 5/1980 Kristapovich ..... F25D 25/04 198/580

* cited by examiner

*Primary Examiner* — Elizabeth J Martin
(74) *Attorney, Agent, or Firm* — Bayramoglu Law Offices LLC

(57) ABSTRACT

An automated three-dimensional refrigerated warehouse for a meat industry is provided. A refrigerated warehouse body is provided with two groups of chain wheels, a chain is sleeved on each group of chain wheels, and a plurality of mounting blocks are uniformly mounted on the chain. The mounting blocks are connected to suspension rods, a supporting table is connected between bottom ends of the suspension rods, an opening is provided in a middle of the supporting table, and a loading cart is placed on the supporting table. The refrigerated warehouse body is connected to two supporting plates, a first electric push rod is arranged above each of the two supporting plates, and top ends of the two first electric push rods are provided with mounting plates. Top ends of the two mounting plates are provided with a horizontal second electric push rod and a horizontal third electric push rod respectively.

15 Claims, 4 Drawing Sheets

AUTOMATED THREE-DIMENSIONAL REFRIGERATED WAREHOUSE FOR MEAT INDUSTRY AND USING METHOD

CROSS REFERENCE TO THE RELATED APPLICATIONS

This application is based upon and claims priority to Chinese Patent Application No. 202211400494.3, filed on Nov. 9, 2022, the entire contents of which are incorporated herein by reference.

TECHNICAL FIELD

The present invention relates to the technical field of three-dimensional refrigeration houses, and in particular to an automated three-dimensional refrigerated warehouse for a meat industry and a using method.

BACKGROUND

As a refrigeration apparatus, a refrigerated warehouse is a kind of apparatus which can store food, liquid, chemicals, medicines, vaccines, scientific experiments and other objects at a constant temperature and humidity in an environment which is created by artificial means and is different from an outdoor temperature or humidity. A three-dimensional refrigerated warehouse is a new type of refrigerated warehouse, which can achieve high-rise rationalization, access automation and easy operation of a warehouse.

At present, more and more meat is processed and produced automatically on an industrial production line. However, after the meat is processed and packaged, in the process of feeding the meat into a refrigerated warehouse, bagged meat products are often fed into the refrigerated warehouse manually or mechanically, and then the bagged meat products are placed on a three-dimensional shelf in the refrigerated warehouse. When the bagged meat products are taken out of the refrigerated warehouse, the bagged meat products are taken down from the three-dimensional shelf first, and then are sent out of the refrigerated warehouse manually or mechanically. Such operations are cumbersome and increase labor.

SUMMARY

The content of the present invention is to provide an automated three-dimensional refrigerated warehouse for a meat industry and a using method, which can solve the problem of cumbersome, time-consuming and laborious operations in the prior art.

The automated three-dimensional refrigerated warehouse for a meat industry of the present invention includes a refrigerated warehouse body, where two groups of chain wheels are arranged on a front wall and a rear wall of the refrigerated warehouse body respectively, and each group of chain wheels are provided with a chain in a sleeving manner. A plurality of mounting blocks are uniformly mounted on the chain, the mounting blocks are connected to rotational suspension rods, and a supporting table is connected between bottom ends of the suspension rods corresponding to the two groups of chain wheels. An opening is provided in a middle of the supporting table, and a loading cart capable of moving left and right is placed on the supporting table.

Two supporting plates are connected between the front wall and the rear wall of the refrigerated warehouse body, a vertical first electric push rod is arranged above each of the two supporting plates, and top ends of the two first electric push rods are provided with mounting plates. Top ends of the two mounting plates are provided with a horizontal second electric push rod and a horizontal third electric push rod respectively, the second electric push rod is capable of extending and retracting leftwards, a left end of the second electric push rod is provided with a first clamping rod, and the first clamping rod is capable of corresponding to the supporting table at the left end. The third electric push rod is capable of extending and retracting rightwards, a right end of the third electric push rod is provided with a second clamping rod, and the second clamping rod is capable of corresponding to the supporting table at the right end.

A left end and a right end of the refrigerated warehouse body are provided with an entrance and an exit respectively, and an outer end of the entrance and an outer end of the exit each are provided with a transverse plate. The entrance is aligned with the supporting table at the left end, and the exit is aligned with the supporting table at the right end. A left end and a right end of a bottom surface of the loading cart each are provided with a notch, the first clamping rod is capable of extending into the notch at the right end to push the loading cart on the supporting table at the left end out of the entrance, and the second clamping rod is capable of extending into the notch at the left end to push the loading cart on the supporting table at the right end out of the exit.

The refrigerated warehouse body is provided with a refrigeration system.

Preferably, the number of each group of chain wheels is four, and the chain wheels are distributed in a left and right symmetrical manner. The chain wheels are rotationally mounted on the front wall and the rear wall of the refrigerated warehouse body by means of shaft rods, the shaft rods are driven by an electric motor, and the electric motor is mounted on an outer wall of the refrigerated warehouse body.

Preferably, the mounting block is provided with a round rod, the round rod is provided with a rotational rotating block in a sleeving manner, and two suspension rods are connected to one rotating block. Top ends of the two suspension rods are fixedly connected to the rotating block, and bottom ends of the two suspension rods are connected to a left end and a right end of the supporting table respectively.

Preferably, stop edges are arranged at a front end and a rear end of the supporting table respectively, and the suspension rods are connected to the stop edges.

Preferably, an anti-slip layer is arranged on a top surface of the supporting table.

Preferably, the entrance and the exit each are provided with an electric door.

Preferably, a right end of the loading cart is provided with a clamping groove, and a pulling plate is arranged in the clamping groove. A bottom surface of the loading cart is provided with rolling wheels.

Preferably, the refrigeration system is a CO/NH cascade refrigeration system.

The present invention provides a using method of an automated three-dimensional refrigerated warehouse for a meat industry, which employs the above automated three-dimensional refrigerated warehouse for a meat industry and includes the following steps:

1) feeding steps:

1.1) making the supporting table correspond to the entrance;

1.2) making the first clamping rod located below the notch at the right end of the bottom surface of the loading cart by means of leftward extension of the second electric push rod;

1.3) lifting the corresponding mounting plate by means of the first electric push rod, such that the first clamping rod enters the notch at the right end;

1.4) driving the loading cart on the supporting table to move leftwards and move onto the transverse plate at the entrance by means of continuous leftward extension of the second electric push rod, and cooperation between the first clamping rod and the notch at the right end;

1.5) conveying bagged meat products to the loading cart, and after the cart is filled, driving the loading cart to move rightwards and go into the refrigerated warehouse body for freezing by means of rightward retraction of the second electric push rod;

1.6) when the loading cart completely enters the refrigerated warehouse body, making the first clamping rod separated from the notch at the right end by means of retraction of the first electric push rod, and then, making the second electric push rod to retract until the first clamping rod leaves the position below the supporting table, thereby completing a loading process of one loading cart; and 1.7) driving the chain to rotate by means of rotation of the two groups of chain wheels, such that the loading cart which has finished loading is lifted and then leaves the entrance, the next loading cart corresponds to the entrance, and the above operations are repeated to complete loading of the next loading cart.

2) Discharging steps:

2.1) making the supporting table correspond to the exit;

2.2) making the second clamping rod located below the notch at the left end of the bottom surface of the loading cart by means of rightward extension of the third electric push rod;

2.3) lifting the corresponding mounting plate by means of the first electric push rod, such that the second clamping rod enters the notch at the left end;

2.4) driving the loading cart on the supporting table to move rightwards and move onto the transverse plate at the exit by means of continuous rightward extension of the third electric push rod, and cooperation between the second clamping rod and the notch at the left end;

2.5) continuously lifting the mounting plate by means of the first electric push rod, such that the left end of the loading cart is raised, and the loading cart is inclined;

2.6) opening a right side of the loading cart by a manipulator to enable the bagged meat products to slide out of the loading cart;

2.7) after discharging is completed, lowering the first electric push rod to make the loading cart horizontal, and then pulling the loading cart back into the refrigerated warehouse body by means of retraction of the third electric push rod;

2.8) continuously lowering the first electric push rod, such that the second clamping rod is separated from the notch at the left end, and then making the third electric push rod continue to retract until the second clamping rod is separated from the position below the supporting table, thereby completing a discharging process of the loading cart; and 2.9) driving the chain to rotate by means of rotation of the two groups of chain wheels, such that the loading cart which has finished discharging is lowered and then leaves the exit, the next loading cart corresponds to the exit, and the above operations are repeated to complete discharging of the next loading cart.

Preferably, the electric door is automatically opened and closed when the loading cart enters the entrance and the exit.

According to the three-dimensional refrigerated warehouse, the loading cart can be automatically moved out of the refrigerated warehouse body for loading and unloading, and can be automatically moved in the refrigerated warehouse body after loading and unloading are completed. Moreover, after loading and unloading of one loading cart are completed, the next loading cart can perform loading and unloading continuously, such that cyclic loading and unloading can be achieved, which is very convenient. According to the three-dimensional refrigerated warehouse, the feeding and discharging process and the loading process are integrated into one, such that a ground loading process is omitted, efficiency is improved, time and labor are saved, and the cost is saved. The three-dimensional refrigerated warehouse is stable in operation, and has a high degree of automation and intelligence.

DETAILED DESCRIPTION OF THE EMBODIMENTS

In order to further understand the content of the present invention, the present invention is described in detail with reference to companying drawings and in conjunction with examples. It should be understood that the example is only an interpretation of the present invention and not a limitation.

Figure 1:
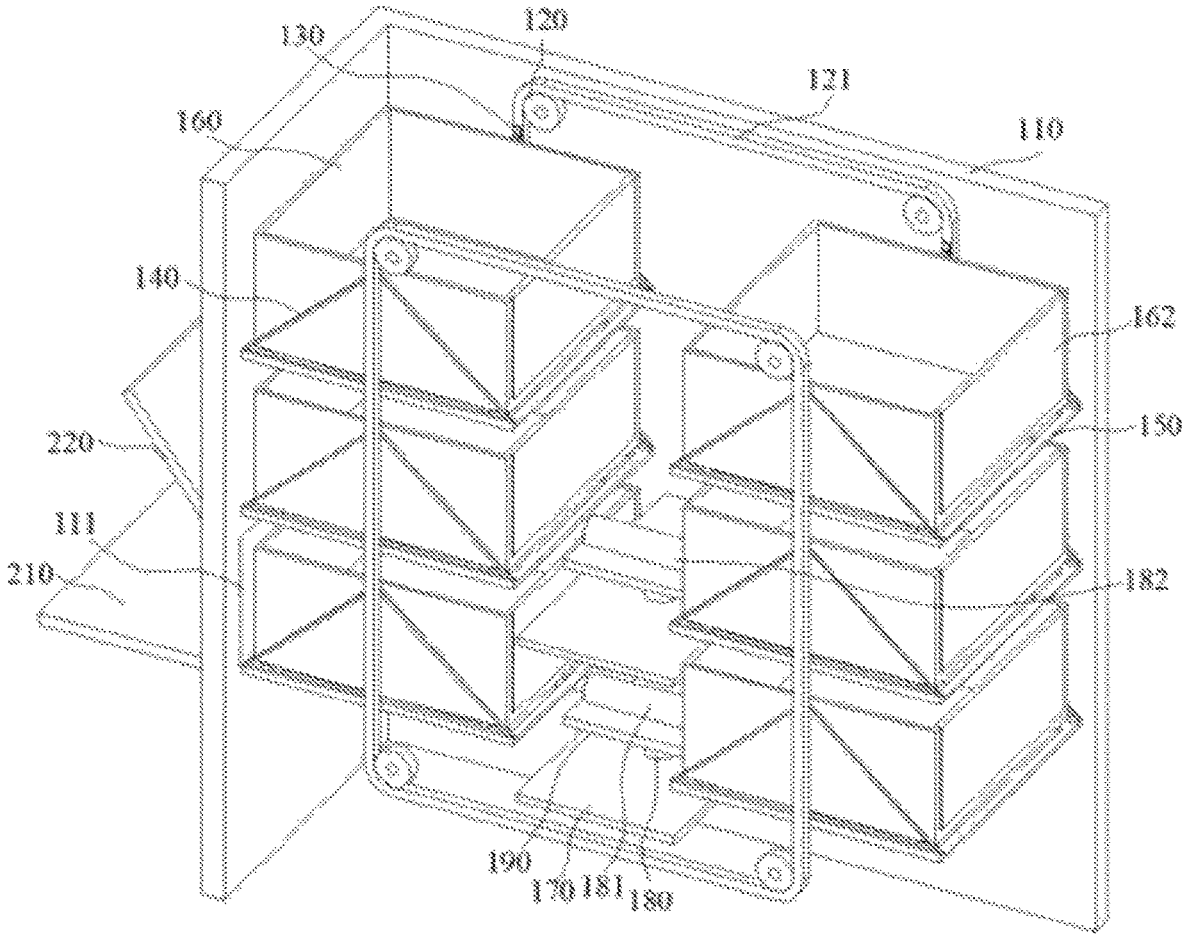
FIG. 1 is a schematic diagram of a three-dimensional structure of an automated three-dimensional refrigerated warehouse for a meat industry in an example.
Figure 2:
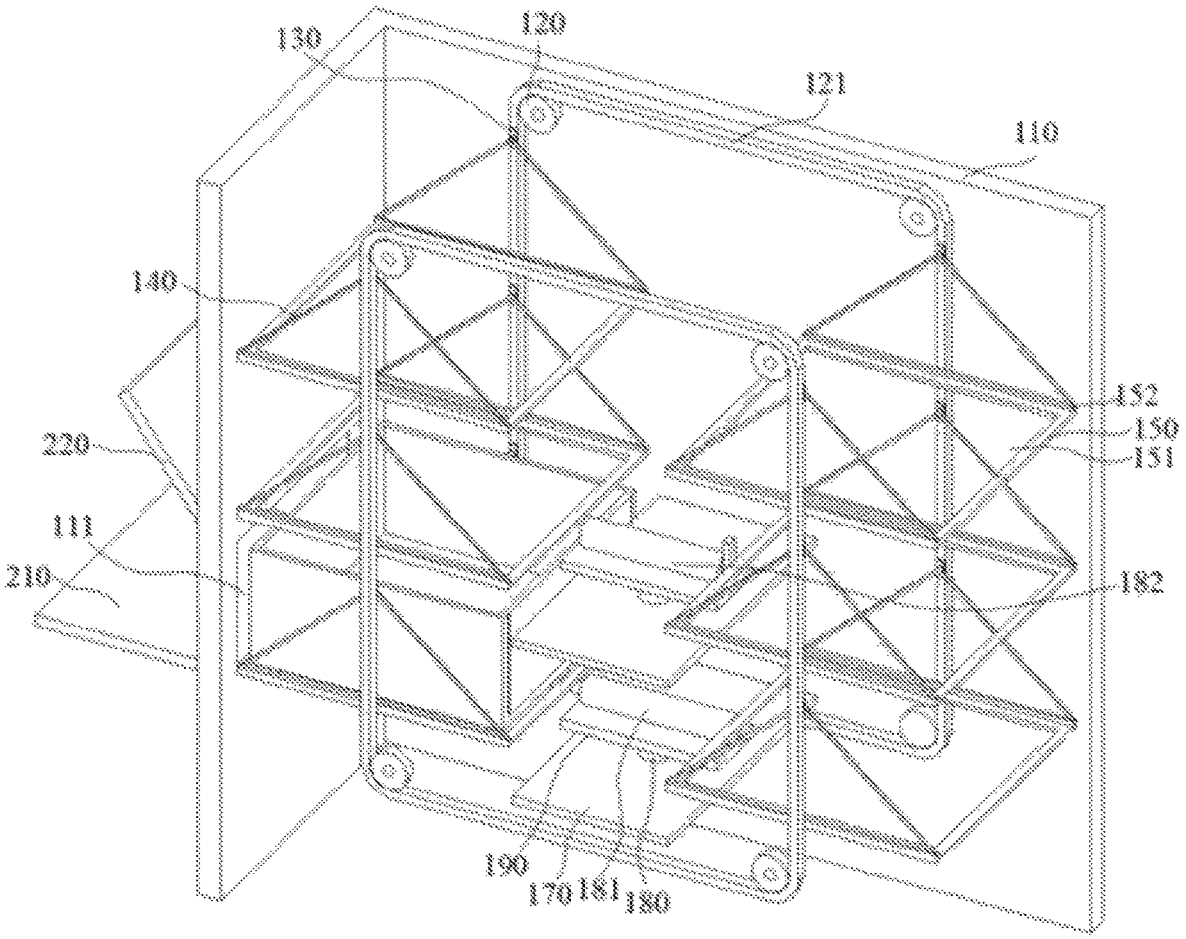
FIG. 2 is a schematic structural diagram of a refrigerated warehouse body in an example.
Figure 3:
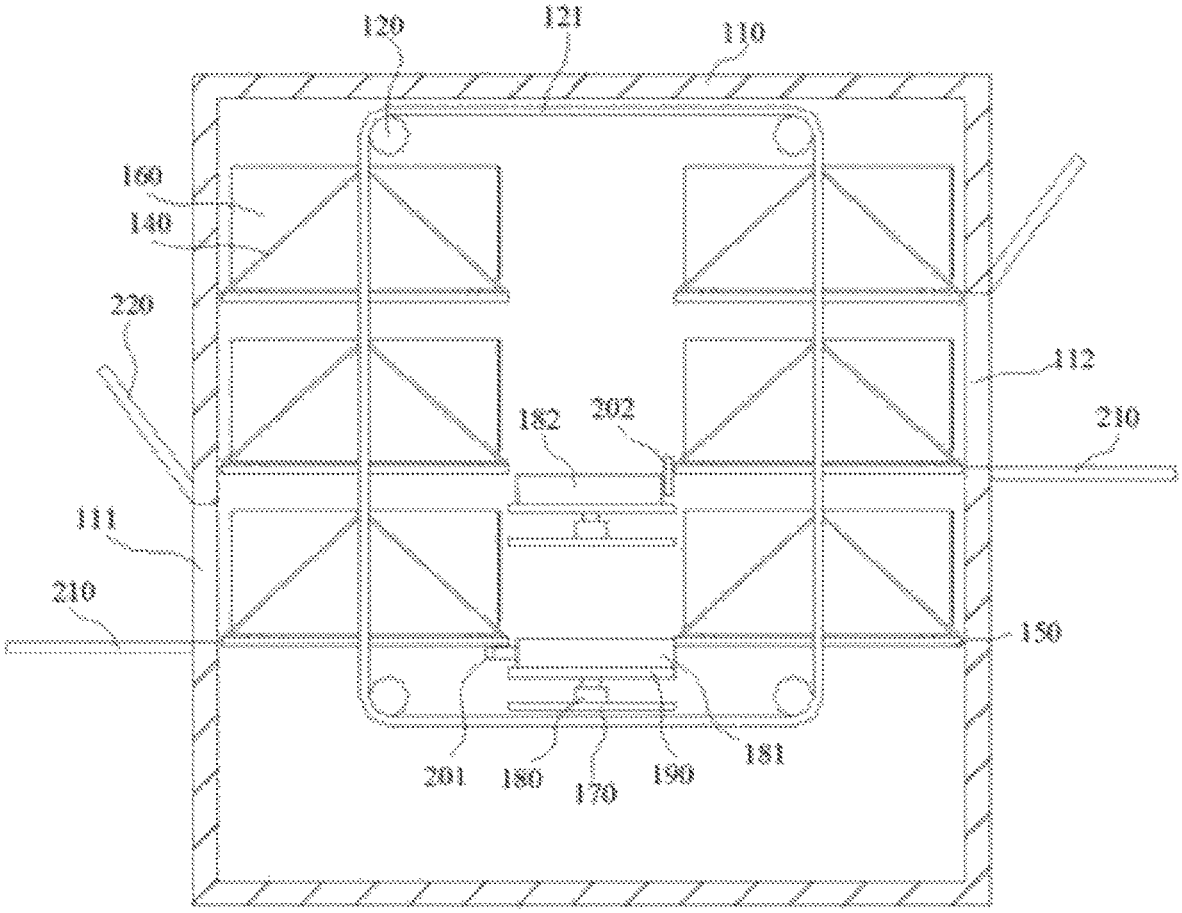
FIG. 3 is a schematic structural diagram from a front view of an automated three-dimensional refrigerated warehouse for a meat industry in an example.
Figure 4:
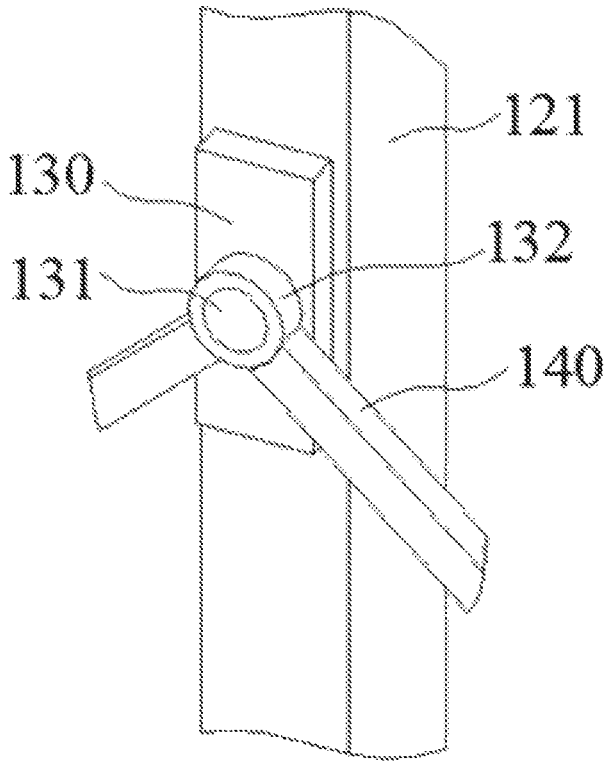
FIG. 4 is a schematic structural diagram of a mounting block in an example.
Figure 5:
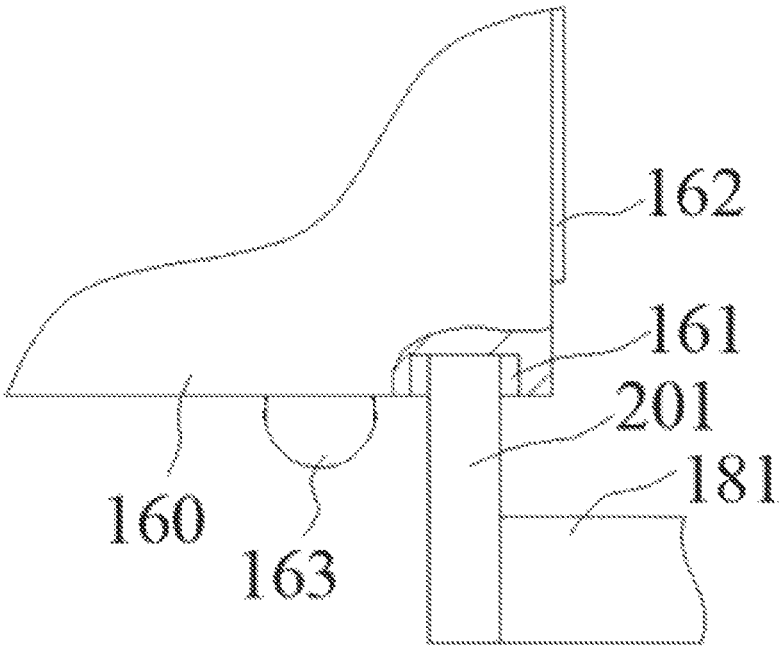
FIG. 5 is a schematic structural diagram of a notch in an example.

Example: As shown in FIG. 1, FIG. 2, FIG. 3, FIG. 4 and FIG. 5, this examples provides an automated three-dimensional refrigerated warehouse for a meat industry includes a refrigerated warehouse body 110, two groups of chain wheels 120 are arranged on a front wall and a rear wall of the refrigerated warehouse body 110 respectively, each group of chain wheels 120 are provided with a chain 121 in a sleeving manner, and a plurality of mounting blocks 130 are uniformly mounted on the chain 121. The mounting blocks 130 are connected to rotational suspension rods 140, a supporting table 150 is connected between bottom ends of the suspension rods 140 corresponding to the two groups of chain wheels 120, an opening 151 is provided in a middle of the supporting table 150, and a loading cart 160 capable of moving left and right is placed on the supporting table 150.

Two supporting plates 170 are connected between the front wall and the rear wall of the refrigerated warehouse body 110, a vertical first electric push rod 180 is arranged above each of the two supporting plates 170, and top ends of the two first electric push rods 180 are provided with mounting plates 190. Top ends of the two mounting plates 190 are provided with a horizontal second electric push rod 181 and a horizontal third electric push rod 182 respectively, the second electric push rod 181 is capable of extending and retracting leftwards, a left end of the second electric push rod is provided with a first clamping rod 201, and the first clamping rod 201 is capable of corresponding to the supporting table 150 at the left end. The third electric push rod 182 is capable of extending and retracting rightwards, a right end of the third electric push rod is provided with a second clamping rod 202, and the second clamping rod 202 is capable of corresponding to the supporting table 150 at the right end.

A left end and a right end of the refrigerated warehouse body 110 are provided with an entrance 111 and an exit 112 respectively, and an outer end of the entrance 111 and an outer end of the exit 112 each are provided with a transverse plate 210. The entrance 111 is aligned with the supporting table 150 at the left end, and the exit 112 is aligned with the supporting table 150 at the right end. A left end and a right end of a bottom surface of the loading cart 160 each are provided with a notch 161, the first clamping rod 201 is capable of extending into the notch 161 at the right end to push the loading cart 160 on the supporting table 150 at the left end out of the entrance 111, and the second clamping rod 202 is capable of extending into the notch 161 at the left end to push the loading cart 160 on the supporting table 150 at the right end out of the exit 112.

The refrigerated warehouse body 110 is provided with a refrigeration system. The refrigeration system can cool the refrigerated warehouse body 110.

The supporting table 150 is arranged between the two groups of chain wheels 120, rotation of the two groups of chain wheels 120 will drive the chain 121 to move, and the chain 121 will drive the supporting table 150 to move circularly, which will drive the loading cart 160 to move circularly up and down, such that the supporting table 150 can correspond to the entrance 111 and the exit 112 circularly, and the cyclic loading and unloading of the loading cart 160 can be achieved.

When the supporting table 150 corresponds to the entrance 111, the second electric push rod 181 extends leftwards, and the loading cart 160 is pushed out of the transverse plate 210 outside the entrance 111 by means of the cooperation between the first clamping rod 201 and the notch 161 at the right end, such that the loading cart 160 can perform loading. Since the first clamping rod 201 can be clamped in the notch 161 at the right end, the loading cart 160 can be brought back through retraction of the second electric push rod 181 after loading is completed, which is very convenient. The corresponding first electric push rod 180 can drive the first clamping rod 201 to lift, such that the first clamping rod 201 can conveniently move in and out of the notch 161 at the right end. When products are not loaded, the first clamping rod 201 can be driven by the second electric push rod 181 to move away from the position below the supporting table 150, such that the first clamping rod 201 does not hinder the circular movement of the supporting table 150.

When the supporting table 150 corresponds to the exit 112, extension of the third electric push rod 182 can drive the second clamping rod 202 to enter the position below the notch 161 at the left end, and then the corresponding first electric push rod 180 can drive the second clamping rod 202 to enter the notch 161 at the left end. In the same way as feeding, the extension and retraction of the third electric push rod 182 can push the loading cart 160 out to the transverse plate 210 at the exit 112, such that a right side of the loading cart 160 is opened for unloading. In order to improve unloading efficiency, after the loading cart 160 reaches a predetermined position of the transverse plate 210, the corresponding first electric push rod 180 can continue to rise to raise a left end of the loading cart 160 (here, the notch 161 at the left end needs to be larger than a rod head of the second clamping rod 202, and can also be designed into a round head structure, such that the second clamping rod 202 can rotate in the notch 161 at the left end, and the left end of the loading cart 160 is ensured to be capable of rising smoothly. The other end of the loading cart 160 will retract by a certain distance under an action of the rolling wheels, which does not interfere with tilting unloading of the loading cart 160) to tilt the loading cart 160 and accelerate an unloading speed of the bagged meat products.

According to the three-dimensional refrigerated warehouse, the loading cart 160 can be automatically moved out of the refrigerated warehouse body 110 for loading and unloading, and the loading cart 160 can also be automatically moved in the refrigerated warehouse body after loading and unloading are completed. Moreover, after loading and unloading of one loading cart 160 are completed, the next loading cart 160 can perform loading and unloading continuously, such that cyclic loading and unloading can be achieved, which is very convenient. According to the three-dimensional refrigerated warehouse, the feeding and discharging process and the loading process are integrated into one, such that a ground loading process is omitted, efficiency is improved, time and labor are saved, and the cost is saved. The three-dimensional refrigerated warehouse is stable in operation, and has a high degree of automation and intelligence.

The number of each group of chain wheels 120 is four, and the chain wheels are distributed in a left and right symmetrical manner. The chain wheels 120 are rotationally mounted on the front wall and the rear wall of the refrigerated warehouse body 110 by means of shaft rods, the shaft rods are driven by an electric motor, and the electric motor is mounted on an outer wall of the refrigerated warehouse body 110. The electric motor drives the shaft rods to rotate, such that rotation of the chain wheels 120 is achieved, and the chain 121 can move circularly.

The mounting block 130 is provided with a round rod 131, the round rod 131 is provided with a rotational rotating block 132 in a sleeving manner, and two suspension rods 140 are connected to one rotating block 132. Top ends of the two suspension rods 140 are fixedly connected to the rotating block 132, and bottom ends of the two suspension rods 140 are connected to a left end and a right end of the supporting table 150 respectively.

The rotating block 132 is arranged, such that the supporting table 150 can rotate, such that the supporting table 150 can keep balance by means of rotation when moving circularly on the chain 121.

Stop edges 152 are arranged at a front end and a rear end of the supporting table 150 respectively, and the suspension rods 140 are connected to the stop edges 152.

The stop edges 152 are arranged, such that the loading cart 160 can be stopped.

An anti-slip layer is arranged on a top surface of the supporting table 150.

The anti-slip layer is arranged, such that rolling wheels on the loading cart 160 can be prevented from slipping.

The entrance 111 and the exit 112 each are provided with an electric door 220.

The electric door 220 can be automatically opened and closed, such that a freezing effect of the refrigeration system can be ensured as much as possible.

A right end of the loading cart 160 is provided with a clamping groove, and a pulling plate 162 is arranged in the clamping groove. A bottom surface of the loading cart 160 is provided with the rolling wheels 163.

After the pulling plate 162 moves upwards, the right end of the loading cart 160 can be opened, such that unloading is conveniently performed. When the pulling plate 162 cooperates with an external manipulator (gripper), automatic pulling of the pulling plate 162 can be achieved.

The refrigeration system is a CO2/NH3 cascade refrigeration system, which is energy-saving and environment-friendly, such that a safety factor is high. The CO2/NH3 cascade refrigeration system belongs to the prior art, which refers to the patent with publication No. CN204648736U. The CO2/NH3 cascade refrigeration system is provided with a refrigeration system waste heat recovery device for cooperation, and the refrigeration system waste heat recovery device refers to the patent with the publication No. CN106969538B. Generated heat can supply heat for a propylene glycol heating system to prevent a refrigerated warehouse floor from being frozen, such that heat energy can be fully utilized, energy consumption is low, and the effects of being energy-saving and environment-friendly can be achieved.

This example provides a using method of an automated three-dimensional refrigerated warehouse for a meat industry, which employs the above automated three-dimensional refrigerated warehouse for a meat industry and includes the following steps:

1) feeding steps:

1.1) make the supporting table 150 correspond to the entrance 111;

1.2) make the first clamping rod 201 located below the notch 161 at the right end of the bottom surface of the loading cart 160 by means of leftward extension of the second electric push rod 181;

1.3) lift the corresponding mounting plate 190 by means of the first electric push rod 180, such that the first clamping rod 201 enters the notch 161 at the right end;

1.4) drive the loading cart 160 on the supporting table 150 to move leftwards and move onto the transverse plate 210 at the entrance 111 by means of continuous leftward extension of the second electric push rod 181, and cooperation between the first clamping rod 201 and the notch 161 at the right end;

1.5) convey bagged meat products to the loading cart 160, and after the cart is filled, drive the loading cart 160 to move rightwards and go into the refrigerated warehouse body 110 for freezing by means of rightward retraction of the second electric push rod 181;

1.6) when the loading cart 160 completely enters the refrigerated warehouse body 110, make the first clamping rod 201 separated from the notch 161 at the right end by means of retraction of the first electric push rod 180, and then, make the second electric push rod 181 to retract until the first clamping rod 201 leaves the position below the supporting table 150, thereby completing a loading process of one loading cart 160; and 1.7) drive the chain 121 to rotate by means of rotation of the two groups of chain wheels 120, such that the loading cart 160 which has finished loading is lifted and then leaves the entrance 111, the next loading cart 160 corresponds to the entrance 111, and the above operations are repeated to complete loading of the next loading cart 160.

2) Discharging steps:

2.1) make the supporting table 150 correspond to the exit 112;

2.2) make the second clamping rod 202 located below the notch 161 at the left end of the bottom surface of the loading cart 160 by means of rightward extension of the third electric push rod 182;

2.3) lift the corresponding mounting plate 190 by means of the first electric push rod 180, such that the second clamping rod 202 enters the notch 161 at the left end;

2.4) drive the loading cart 160 on the supporting table 150 to move rightwards and move onto the transverse plate 210 at the exit 112 by means of continuous rightward extension of the third electric push rod 182, and cooperation between the second clamping rod 202 and the notch 161 at the left end;

2.5) continuously lift the mounting plate 190 by means of the first electric push rod 180, such that the left end of the loading cart 160 is raised, and the loading cart 160 is inclined;

2.6) open a right side of the loading cart 160 by a manipulator (pull the pulling plate 162) to enable the bagged meat products to slide out of the loading cart 160;

2.7) after discharging is completed, lower the first electric push rod 180 to make the loading cart 160 horizontal, and then pull the loading cart 160 back into the refrigerated warehouse body 110 by means of retraction of the third electric push rod 182;

2.8) continuously lower the first electric push rod 180, such that the second clamping rod 202 is separated from the notch 161 at the left end, and then make the third electric push rod 182 continue to retract until the second clamping rod 202 is separated from the position below the supporting table 150, thereby completing a discharging process of the loading cart 160; and 2.9) drive the chain 121 to rotate by means of rotation of the two groups of chain wheels 120, such that the loading cart 160 which has finished discharging is lowered and then leaves the exit 112, the next loading cart 160 corresponds to the exit 112, and the above operations are repeated to complete discharging of the next loading cart 160.

The electric door 220 is automatically opened and closed when the loading cart 160 enters the entrance 111 and the exit 112.

The method provided in this example can conveniently move the loading cart 160 out of the refrigerated warehouse body 110 for loading and unloading.

The accompanying drawings provided in this example are schematic diagrams, and the size thereof is relatively large. In order to highlight structural features more obviously, those skilled in the art can adjust a size ratio according to actual situations so as to satisfy needs in an actual process.

There are also some defects in this example, but these defects are not technical problems actually solved by this example, so these defects are not described in detail in this example. For example, the problem that the loading cart 160 is unstable on the supporting table 150 can be solved at the time of feeding. After loading is completed, the bagged meat products can be evenly arranged, such that the center of gravity of the loading cart 160 is in the middle. In this way, the loading cart 160 is relatively stable on the supporting table 150, and the small problem of unstable center of gravity can be ignored. Such a problem can also be solved by setting the rotation of the rotating block 132 into electric motor control, and the supporting table 150 is made in a horizontal state by controlling the electric motor.

For another example, the loading cart 160 is not stable enough when entering the entrance 111 and the exit 112, and the rotating block 132 is likely to rotate. In this case, electrically stretchable supporting rods may be added at the entrance 111 and the exit 112, the supporting table 150 is supported by the supporting rods, and for the other end, the first clamping rod 201 and the second clamping rod 202 have a supporting function, such that stability of the supporting table 150 during loading and unloading is ensured better. The supporting rods can be shortened and can be retracted when not in use, such that cyclic movement of the supporting table 150 is prevented from being hindered. Of course, the stability of the supporting table 150 can also be ensured by controlling the supporting table 150 by the electric motor as described above.

The above schematic description of the present invention and its embodiments is not restrictive. What is shown in the accompanying drawings is merely one of the embodiments of the present invention, and an actual structure is not limited thereto. Therefore, structural manners and examples, similar to the technical solution, designed without creative efforts by those of ordinary skill in the art under inspiration by such embodiments without departing from the creative purposes of the present invention shall fall within the protection scope of the present invention.

What is claimed is:

1. An automated three-dimensional refrigerated warehouse for a meat industry, comprising a refrigerated warehouse body, two groups of chain wheels are arranged on a front wall and a rear wall of the refrigerated warehouse body respectively, each group of chain wheels are provided with a chain in a sleeving manner, a plurality of mounting blocks are uniformly mounted on the chain, the mounting blocks are connected to rotational suspension rods, a supporting table is connected between bottom ends of the suspension rods corresponding to the two groups of chain wheels, an opening is provided in a middle of the supporting table, and a loading cart capable of moving left and right is placed on the supporting table;

two supporting plates are connected between the front wall and the rear wall of the refrigerated warehouse body, a vertical first electric push rod is arranged above each of the two supporting plates, top ends of the two first electric push rods are provided with mounting plates, top ends of the two mounting plates are provided with a horizontal second electric push rod and a horizontal third electric push rod respectively, the second electric push rod is capable of extending and retracting leftwards, a left end of the second electric push rod is provided with a first clamping rod, the first clamping rod is capable of corresponding to the supporting table at the left end, the third electric push rod is capable of extending and retracting rightwards, a right end of the third electric push rod is provided with a second clamping rod, and the second clamping rod is capable of corresponding to the supporting table at the right end;

a left end and a right end of the refrigerated warehouse body are provided with an entrance and an exit respectively, and an outer end of the entrance and an outer end of the exit each are provided with a transverse plate; the entrance is aligned with the supporting table at the left end, and the exit is aligned with the supporting table at the right end; a left end and a right end of a bottom surface of the loading cart each are provided with a notch, the first clamping rod is capable of extending into the notch at the right end to push the loading cart on the supporting table at the left end out of the entrance, and the second clamping rod is capable of extending into the notch at the left end to push the loading cart on the supporting table at the right end out of the exit.

2. The automated three-dimensional refrigerated warehouse for the meat industry according to claim 1, wherein a number of each group of chain wheels is four, and the chain wheels are distributed in a left and right symmetrical manner; and the chain wheels are rotationally mounted on the front wall and the rear wall of the refrigerated warehouse body by means of shaft rods, the shaft rods are driven by an electric motor, and the electric motor is mounted on an outer wall of the refrigerated warehouse body.

3. The automated three-dimensional refrigerated warehouse for the meat industry according to claim 2, wherein the mounting block is provided with a round rod, the round rod is provided with a rotational rotating block in a sleeving manner, two suspension rods are connected to one rotating block, top ends of the two suspension rods are fixedly connected to the rotating block, and bottom ends of the two suspension rods are connected to a left end and a right end of the supporting table respectively.

4. The automated three-dimensional refrigerated warehouse for the meat industry according to claim 3, wherein stop edges are arranged at a front end and a rear end of the supporting table respectively, and the suspension rods are connected to the stop edges.

5. The automated three-dimensional refrigerated warehouse for the meat industry according to claim 4, wherein an anti-slip layer is arranged on a top surface of the supporting table.

6. The automated three-dimensional refrigerated warehouse for the meat industry according to claim 5, wherein the entrance and the exit each are provided with an electric door.

7. The automated three-dimensional refrigerated warehouse for the meat industry according to claim 6, wherein a right end of the loading cart is provided with a clamping groove, and a pulling plate is arranged in the clamping groove; and a bottom surface of the loading cart is provided with rolling wheels.

8. The method according to claim 1, and comprising the following steps:

1) feeding steps:

1.1) making the supporting table correspond to the entrance;

1.2) making the first clamping rod located below the notch at the right end of the bottom surface of the loading cart by means of leftward extension of the second electric push rod;

1.3) lifting the corresponding mounting plate by means of the first electric push rod, such that the first clamping rod enters the notch at the right end;

1.4) driving the loading cart on the supporting table to move leftwards and move onto the transverse plate at the entrance by means of continuous leftward extension of the second electric push rod, and cooperation between the first clamping rod and the notch at the right end;

1.5) conveying bagged meat products to the loading cart, and after the cart is filled, driving the loading cart to move rightwards and go into the refrigerated warehouse body for freezing by means of rightward retraction of the second electric push rod;

1.6) when the loading cart completely enters the refrigerated warehouse body, making the first clamping rod separated from the notch at the right end by means of retraction of the first electric push rod, and then, making the second electric push rod to retract until the first clamping rod leaves the position below the supporting table, thereby completing a loading process of one loading cart;

1.7) driving the chain to rotate by means of rotation of the two groups of chain wheels, such that the loading cart which has finished loading is lifted and then leaves the entrance, the next loading cart corresponds to the entrance, and the above operations are repeated to complete loading of the next loading cart;

2) discharging steps:

2.1) making the supporting table correspond to the exit;

2.2) making the second clamping rod located below the notch at the left end of the bottom surface of the loading cart by means of rightward extension of the third electric push rod;

2.3) lifting the corresponding mounting plate by means of the first electric push rod, such that the second clamping rod enters the notch at the left end;

2.4) driving the loading cart on the supporting table to move rightwards and move onto the transverse: plate at the exit by means of continuous rightward extension of the third electric push rod, and cooperation between the second clamping rod and the notch at the left end;

2.5) continuously lifting the mounting plate by means of the first electric push rod, such that the left end of the loading cart is raised, and the loading cart is inclined;

2.6) opening a right side of the loading cart by a manipulator to enable the bagged meat products to slide out of the loading cart;

2.7) after discharging is completed, lowering the first electric push rod to make the loading cart horizontal, and then pulling the loading cart back into the refrigerated warehouse body by means of retraction of the third electric push rod;

2.8) continuously lowering the first electric push rod, such that the second clamping rod is separated from the notch at the left end, and then making the third electric push rod continue to retract until the second clamping rod is separated from the position below the supporting table, thereby completing a discharging process of the loading cart; and 2.9) driving the chain to rotate by means of rotation of the two groups of chain wheels, such that the loading cart which has finished discharging is lowered and then leaves the exit, the next loading cart corresponds to the exit, and the above operations are repeated to complete discharging of the next loading cart.

9. The method according to claim 8, wherein the electric door is automatically opened and closed when the loading cart enters the entrance and the exit.

10. The method according to claim 8, wherein in the automated three-dimensional refrigerated warehouse for the meat industry, a number of each group of chain wheels is four, and the chain wheels are distributed in a left and right symmetrical manner; and the chain wheels are rotationally mounted on the front wall and the rear wall of the refrigerated warehouse body by means of shaft rods, the shaft rods are driven by an electric motor, and the electric motor is mounted on an outer wall of the refrigerated warehouse body.

11. The method according to claim 10, wherein in the automated three-dimensional refrigerated warehouse for the meat industry, the mounting block is provided with a round rod, the round rod is provided with a rotational rotating block in a sleeving manner, two suspension rods are connected to one rotating block, top ends of the two suspension rods are fixedly connected to the rotating block, and bottom ends of the two suspension rods are connected to a left end and a right end of the supporting table respectively.

12. The method according to claim 11, wherein in the automated three-dimensional refrigerated warehouse for the meat industry, stop edges are arranged at a front end and a rear end of the supporting table respectively, and the suspension rods are connected to the stop edges.

13. The method according to claim 12, wherein in the automated three-dimensional refrigerated warehouse for the meat industry, an anti-slip layer is arranged on a top surface of the supporting table.

14. The method according to claim 13, wherein in the automated three-dimensional refrigerated warehouse for the meat industry, the entrance and the exit each are provided with an electric door.

15. The method according to claim 14, wherein in the automated three-dimensional refrigerated warehouse for the meat industry, a right end of the loading cart is provided with a clamping groove, and a pulling plate is arranged in the clamping groove; and a bottom surface of the loading cart is provided with rolling wheels.

* * * * *